US005552103A

United States Patent [19]

Lee

[11] Patent Number: 5,552,103

[45] Date of Patent: Sep. 3, 1996

[54] FORM SET-UP AND METHOD FOR STRIPPING UPRIGHT FORM PANELS OF THE FORM SET-UP FROM A CONCRETE UNIT

[76] Inventor: Wen-Yuan Lee, 7F-3, No. 8, Lane 390, Sec. 1, Chien-Kang Rd., Tainan City, Taiwan

[21] Appl. No.: 374,301

[22] Filed: Jan. 18, 1995

[51] Int. Cl.[6] ..... B28B 7/10; E04B 1/16; E04G 11/06; E04G 17/06

[52] U.S. Cl. ..... 264/334; 249/47; 249/193; 249/219.2; 264/31

[58] Field of Search ..... 264/334, 31; 249/47, 249/193, 219.2

[56] References Cited

U.S. PATENT DOCUMENTS

| | | | |
|---|---|---|---|
| 1,300,436 | 4/1919 | McKay | 249/193 |
| 1,315,027 | 9/1919 | McKay | 249/193 |
| 2,904,870 | 9/1959 | Hillberg | 249/219.2 X |
| 2,964,294 | 12/1960 | Imonetti . | |
| 3,550,898 | 12/1970 | Ursini . | |
| 4,520,990 | 6/1985 | Maier | 249/47 |
| 4,619,433 | 10/1986 | Maier | 264/32 X |
| 4,666,643 | 5/1987 | Spencer | 264/32 X |
| 4,901,497 | 2/1990 | Lee . | |
| 4,957,272 | 9/1990 | Lee . | |
| 5,078,360 | 1/1992 | Spera | 249/47 X |
| 5,125,617 | 6/1992 | Miller | 249/219.2 X |

*Primary Examiner*—Karen Aftergut

*Attorney, Agent, or Firm*—Birch, Stewart, Kolasch & Birch, LLP

[57] ABSTRACT

A form set-up and a method for stripping upright form panels of the form set-up from a concrete unit. The form set-up defines a pouring space into which concrete is poured and cast so as to form a concrete unit. The form set-up includes at least two form panels. Each of the form panels has a contact surface in contact with a vertical surface of the concrete unit, a mounting surface opposed to the contact surface, and a reinforcing beam member secured to the mounting surface. The reinforcing beam members of the two form panels are aligned with each other. An interconnecting member is interposed removably between the two form panels and has a contact surface which is flush with the contact surfaces of the two form panels and which is in contact with the vertical surface of the concrete unit. A driving assembly is interposed between the reinforcing beam members and is activable to move the reinforcing beam members toward each other so as to move the two form panels toward each other in order to separate the two form panels from the concrete unit when the interconnecting member is removed from the form panels.

7 Claims, 9 Drawing Sheets

FORM SET-UP AND METHOD FOR STRIPPING UPRIGHT FORM PANELS OF THE FORM SET-UP FROM A CONCRETE UNIT

BACKGROUND OF THE INVENTION

1. Field of the Invention

This invention relates to a form set-up and a method for stripping upright form panels of the form set-up from a concrete unit, more particularly to a form setup and a method for easily and conveniently stripping form panels of the form set-up from the concrete unit.

2. Description of the Related Art

Referring to FIG. 1, a conventional form set-up defines a pouring space (S) into which concrete is poured and cast so as to form a concrete unit (C). The conventional form set-up consists of four inner form walls 1 and four outer form walls (3). Each of the inner form walls 1 consists of a plurality of upright form panels and an interconnecting member (A) which is wedged between two selected form panels of the form wall 1 and which divides the form wall 1 into first and second wall parts.

To strip the form panels from the concrete unit (C), the interconnecting member (A) of each of the form walls 1 is initially moved inwardly in the direction indicated by a respective arrow (F). Since the interconnecting member (A) is wedged between two selected form panels of the form wall 1, removal of the interconnecting member (A) will cause movement of the first and second wall parts toward each other so as to separate the form panels from the concrete unit (C).

The aforementioned method for stripping form panels from the concrete unit has the following drawback:

Since the interconnecting member (A) is wedged between two selected form panels, removal of the interconnecting member (A) is laborious since a relative large force which must overcome the abutting force applied on the interconnecting member (A) by the first and second wall parts and the adhesive force between the concrete unit (C) and the interconnecting member (A) is required. It is particularly true when the form panels are made of steel.

SUMMARY OF THE INVENTION

Therefore, the main objective of the present invention is to provide a form set-up and a method for easily and conveniently stripping upright form panels of the form set-up from the concrete unit.

According to the present invention, a Form set-up defines a pouring space into which concrete is poured and cast so as to form a concrete unit having at least one vertical surface. The form set-up includes at least two upright form panels. Each of the form panels has a contact surface in contact with the vertical surface of the concrete unit, a mounting surface opposed to the contact surface, and a reinforcing beam member secured to the mounting surface. The reinforcing beam members of the two form panels are aligned with each other. An interconnecting member is interposed removably between the two form panels. The interconnecting member has a contact surface which is flush with the contact surfaces of the two form panels and which is in contact with the vertical surface of the concrete unit. A driving assembly is interposed between the reinforcing beam members and is activable to move the reinforcing beam members toward each other so as to move the two form panels toward each other in order to separate the two form panels from the concrete unit when the interconnecting member is removed from the form panels.

In another aspect of the present invention, a method is provided for stripping upright form panels from a concrete unit having at least one vertical surface. The form panels constitute a form set-up defining a pouring space into which concrete is poured and cast so as to form said concrete unit. The form set-up includes at least two upright form panels and an interconnecting member interposed removably between the two form panels. Each of the two form panels has a contact surface in contact with the vertical surface of the concrete unit, a mounting surface opposed to the contact surface, and a reinforcing beam member secured to the mounting surface. The reinforcing beam members of the form panels are aligned with each other. The stripping method includes the steps of: (a) interposing a driving assembly between the reinforcing beam members; (b) removing the interconnecting member from the two form panels so as to leave a space between the two form panels; and (c) activating the driving assembly to move the reinforcing beam members toward each other so as to move the two form panels toward each other in order to separate the two form panels from the concrete unit.

BRIEF DESCRIPTION OF THE DRAWINGS

Other features and advantages of the present invention will become apparent in the following detailed description of the preferred embodiments, with reference to the accompanying drawings, in which.

DETAILED DESCRIPTION OF THE PREFERRED EMBODIMENT

A form set-up according to a first embodiment of the present invention includes a plurality of inner form walls and a plurality of outer form walls. The inner and outer form walls cooperatively define a pouring space into which concrete is poured and cast so as to form a concrete unit having at least one vertical surface.

Figure 2:
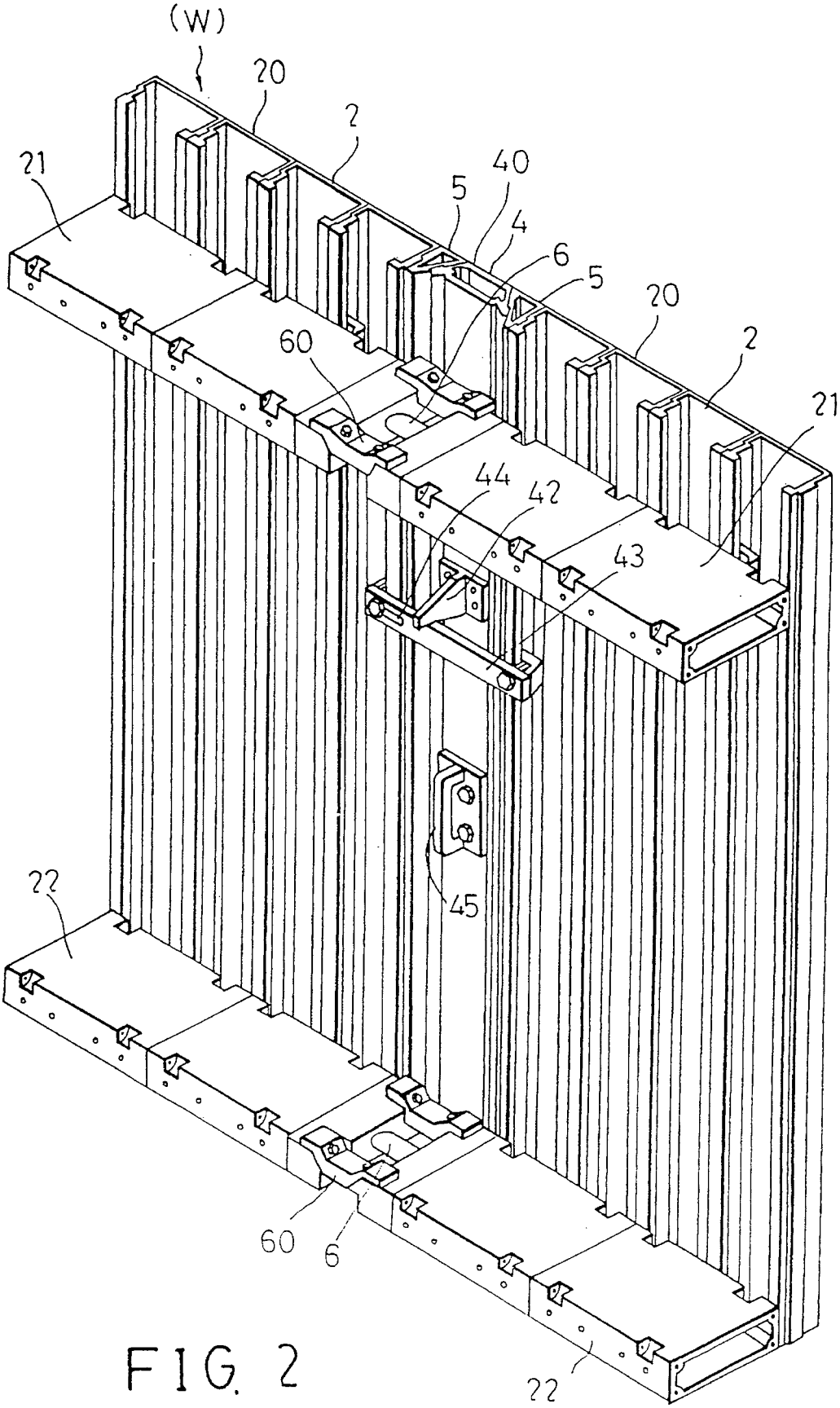
FIG. 2 is a schematic perspective view showing an inner form wall of a form set-up according to a first embodiment of the present invention.
Figure 3:
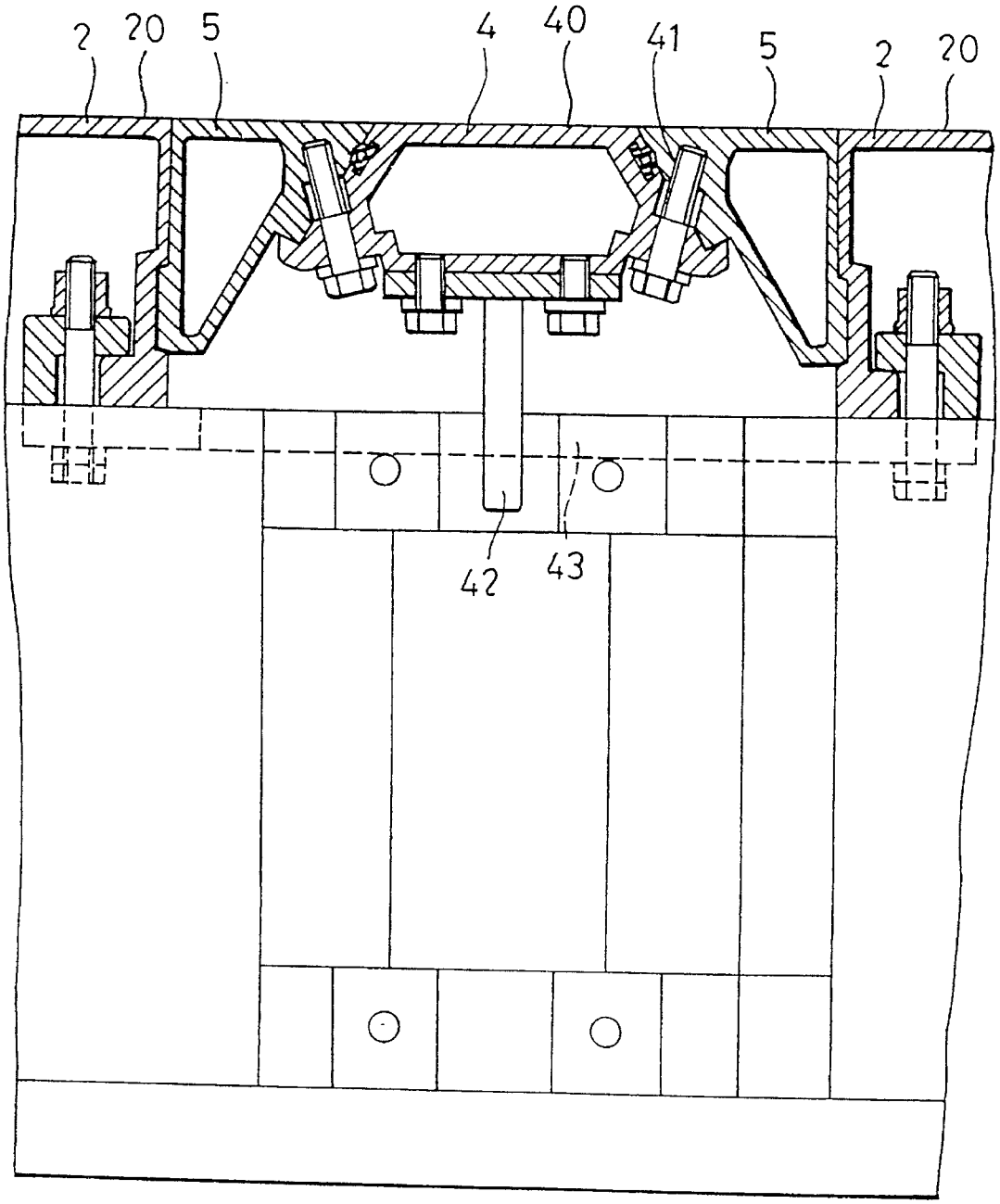
FIG. 3 is a fragmentary top plan view of the form set-up in FIG. 2.

Referring to FIGS. 2 and 3, one of the inner form walls (W) of the form set-up of the first embodiment is shown to include a plurality of upright form panels 2, two connecting members 5, an interconnecting member 4 and two driving assemblies 6.

Each of the form panels 2 has a contact surface 20 which is in contact with the vertical surface (not shown) of the concrete unit (not shown), a mounting surface which is opposed to the contact surface 20, an upper reinforcing beam member 21 which is secured to the mounting surface 20, and a lower reinforcing beam member 22 which is secured to the mounting surface 20 and which is spaced from the upper reinforcing beam member 21. The upper reinforcing beam members 21 of the form panels 2 are aligned with each other, while the lower reinforcing beam members 22 are aligned with each other.

The connecting members 5 are interposed between two selected form panels 2 which are usually located at the central portion of the form wall (W) so as to divide the form wall (W) into first and second wall parts. The connecting members 5 are connected respectively to a respective one of the two selected form panels 2 and cooperatively define a space therebetween. In the present embodiment, the connecting members 5 cooperatively define a trapezoid-shaped space.

Figure 4:
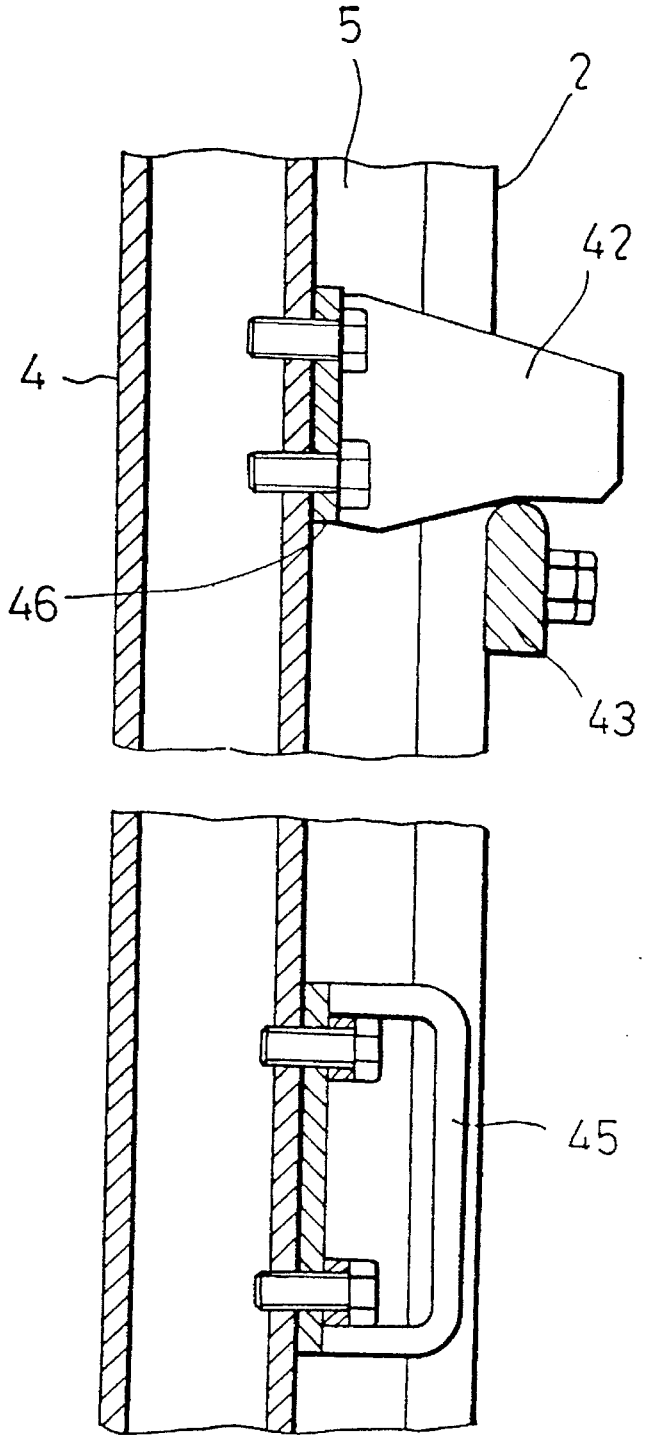
FIG. 4 is a fragmentary, partial sectional view illustrating the form set-up in FIG. 2.

The interconnecting member 4 is interposed between the connecting members 5 and is connected to the connecting members 5 by means of conventional fasteners 41. In the present embodiment, the interconnecting member 4 is trapezoid in cross-section so as to be received fittingly in the receiving space. The interconnecting member 4 has a contact surface 40 which is flush with the contact surface 20 of the form panels 2 and which is in contact with the vertical surface of the concrete unit. The interconnecting member 4 further has a mounting surface which is opposed to the contact surface 40 and which has a handle member 45 secured thereon. A holding plate 42 extends outwardly from the mounting surface of the interconnecting member 4 and has a lower edge formed with an upwardly extending indentation 46 (see FIG. 4). A support member 43 has a first end portion connected to the mounting surface of one of the two selected form panels 2 by means of a conventional fastener and a second end portion which is formed with a slot 44 extending in a direction toward the first end portion and which is connected to the mounting surface of the other one of the two selected form panels 2 by the extension of a conventional fastener through the slot 44 and into the form panel 2.

Figure 5:
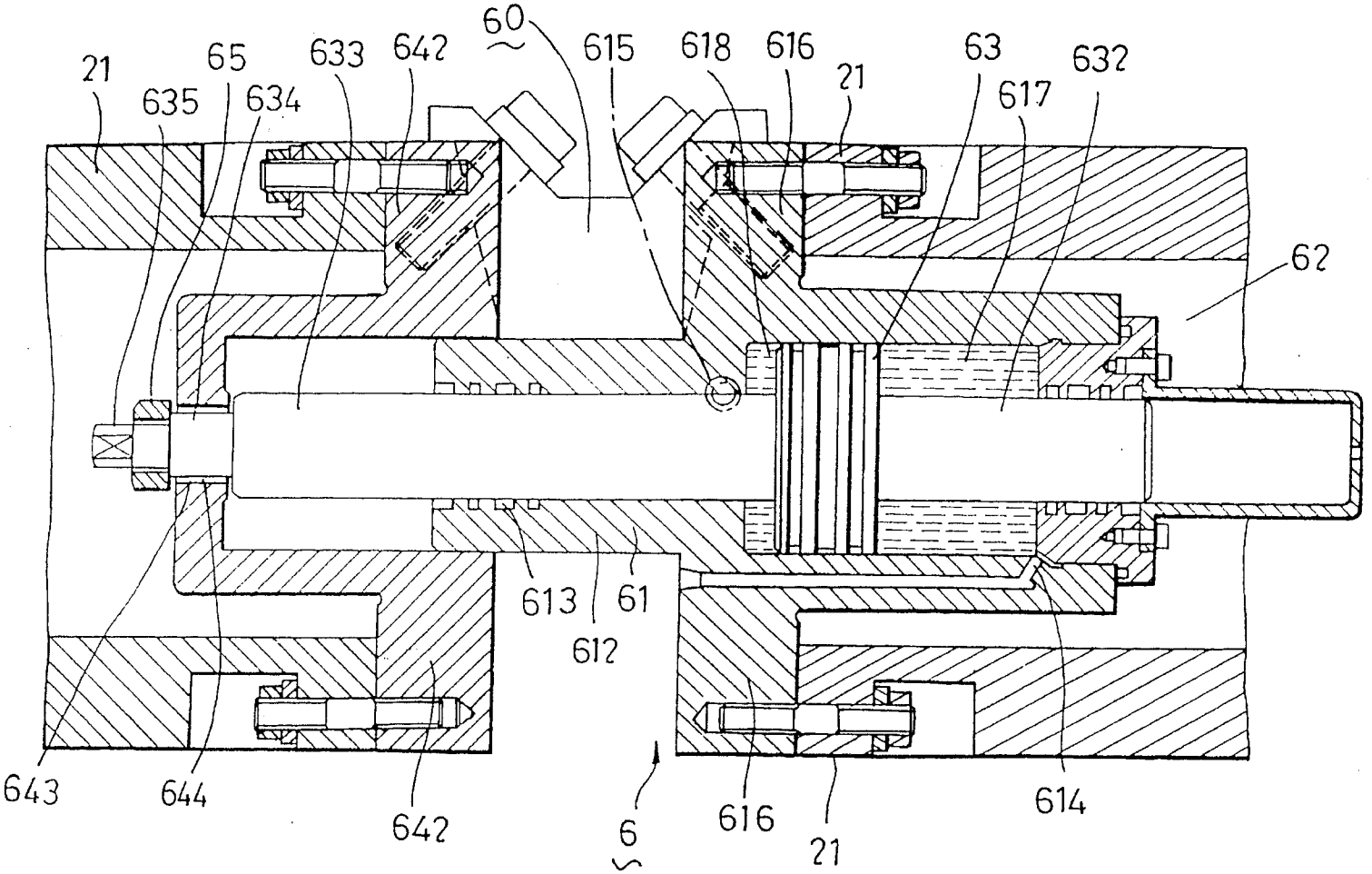
FIG. 5 is a partial sectional view illustrating a driving assembly of the form set-up in FIG. 2.

Referring now to FIGS. 2 and 5, in the present embodiment, each of the driving assemblies 6 includes a first mounting seat 616, a second mounting seat 642, and a hydraulic cylinder 62. The first mounting seat 616 of each driving assembly 6 is secured to a respective one of the upper and lower reinforcing beam members, 21 and 22, of one of the two selected form panels 2 adjacent to the interconnecting member 4. The second mounting seat 642 of each driving assembly 6 is secured to a respective one of the reinforcing beam members 21, 22 of the other one of the two selected form panels 2 adjacent to the interconnecting member 4. The hydraulic cylinder 62 of each driving assembly 6 includes a stationary body 61 which is mounted on a respective one of the first mounting seats 616, and a piston rod 633 which has a first distal end 634 extending outwardly from the stationary body 61. The piston rod 633 further has a second distal end 632 which extends into an oil chamber of the stationary body 61 and which has a piston 63 mounted thereon. The piston 63 divides the oil chamber which is filled with hydraulic oil, into a first variable oil chamber 618 and a second variable oil chamber 617. The stationary body 61 is formed with a first oil passage 615 which communicates with the first variable oil chamber 618 and a second oil passage 614 which communicates with the second variable oil chamber 617. In operation, hydraulic oil is fed into the first variable oil chamber 618 via the first oil passage 615 so as to cause axial movement of the piston 63 toward the second variable oil chamber 617. Axial movement of the piston 63 toward the second variable oil chamber 617 results in the axial movement of the first distal end 634 of the piston rod 633 toward the stationary body 61. As the piston 63 moves toward the second variable oil chamber 617, the volume of the first variable oil chamber 618 is increased such that the volume of the second variable oil chamber 617 is correspondingly decreased. The hydraulic oil in the second variable oil chamber 617 is thus expelled from the second variable oil chamber 617 via the second oil passage 614.

The first distal end 634 of each piston rod 63 extends through a through-hole 643 of a respective one of the second mounting seats 642 and is formed with an externally threaded extension 635 which engages a locking nut 65 so as to connect the first distal end 634 of the piston rod 633 to the second mounting seat 642 in order to move the first distal end 634 of the piston rod 633 toward the stationary body 61 when the piston 63 moves toward the second variable oil chamber 617. Between the mounting seats 616,642 of each driving assembly 6, two stop members 60 are interposed removably so as to prevent untimely movement of the piston rod 633 toward the stationary body 61 when concrete is poured and cast into the pouring space.

It should be appreciated that the diameter of the through-hole 643 is larger than that of the first distal end 634 of the piston rod 633 so as to avoid the need for precisely aligning the through-hole 643 with the first distal end 634 of the piston 633 and so as to permit flowing of air therethrough in order to provide a smooth operation of the hydraulic cylinder 62.

To strip the form panels 2 from the concrete unit, referring once more to FIGS. 2 and 3, the interconnecting member 4 is initially disconnected from the connecting members 5 by releasing the fasteners 41. The handle member 45 can then be gripped by the hand (not shown) of an operator (not shown) so as to assist in the removal of the interconnecting member 4 from the connecting members 5. Thereafter, the interconnecting member 4 can be lifted by a lifting equipment (not shown) so as to leave the space between the connecting members 5. Before the interconnecting member 4 is lifted, the interconnecting member 4 may be supported on the support member 43 by resting the holding plate 42 on the support member 43 with the indentation 46 of the holding plate 42 engaging the support member 43 so as to save the operator's effort. After the interconnecting member 4 is lifted, the fastener which extends through the slot 44 of the support member 43, is released. At the same time, the stop members 60 are removed such that the driving assemblies 6 can be operated to move the first distal end 634 of the piston rod 633 toward the stationary body 61 so as to result in the movement of the upper reinforcing members 21 toward each other and, in turn, in the movement of the lower reinforcing members 22 toward each other in order to move the two selected form panels 2 toward each other, thereby causing the first and second wall parts to move toward each other so as to separate the form panels 2 from the concrete unit.

It should be noted that, if the interconnecting member 4 is directly lifted after releasing the fasteners 41, the support member 43 and the holding plate 42 can be omitted. Furthermore, if the form panels of all of the inner form walls of the form setup are desired to be stripped simultaneously from the concrete unit, all of the driving assemblies must be operated simultaneously.

Accordingly, since the interconnecting member 4 is not wedged between the two selected form panels 2, removal of the interconnecting member 4 is easy to achieve. Furthermore, it is more labor-saving to move the first and second wall parts toward each other by operating the driving assemblies 6 as compared with the prior art.

Figure 1:
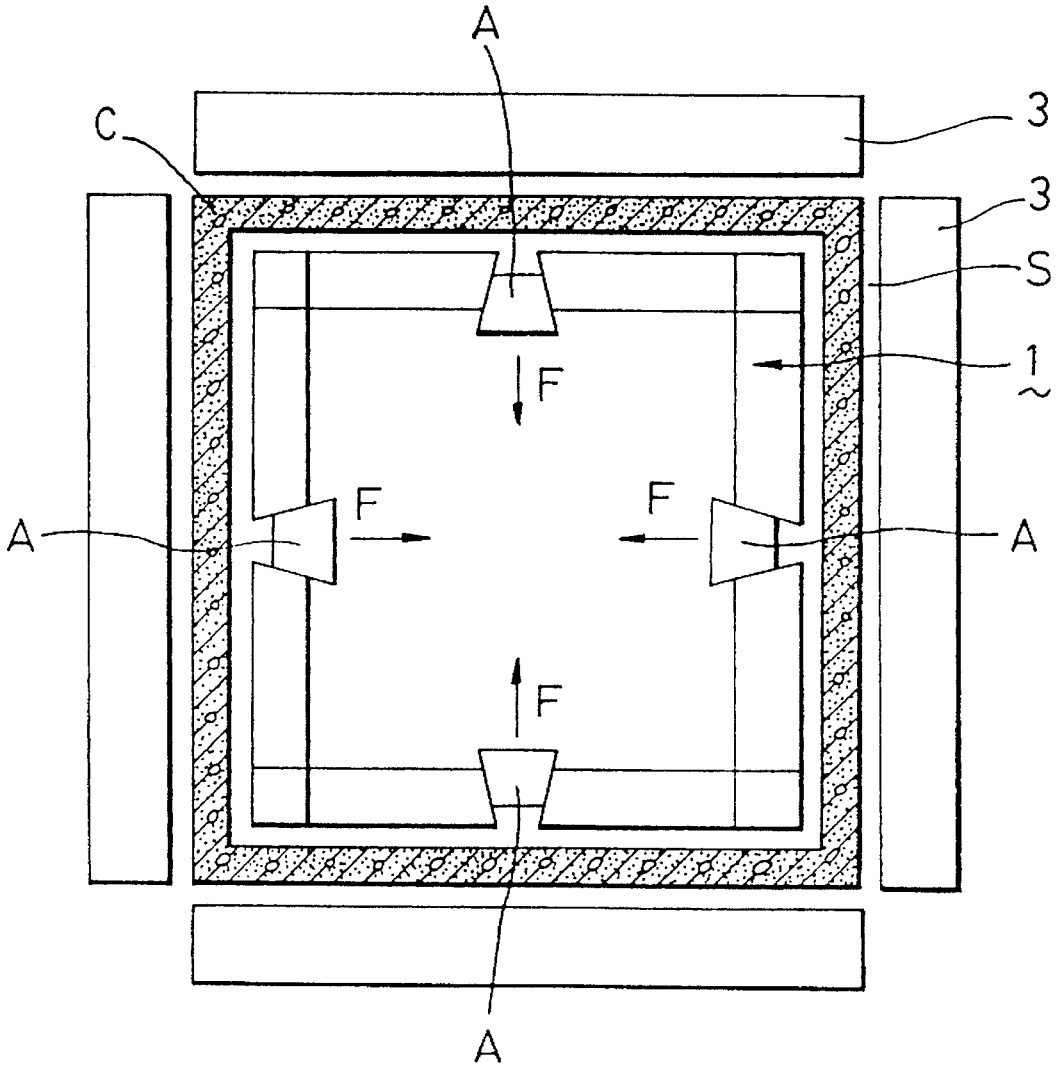
FIG. 1 (PRIOR ART)
FIG. 1 is a schematic view showing the removal of interconnecting members from form panels of a conventional form set-up.
Figure 6:
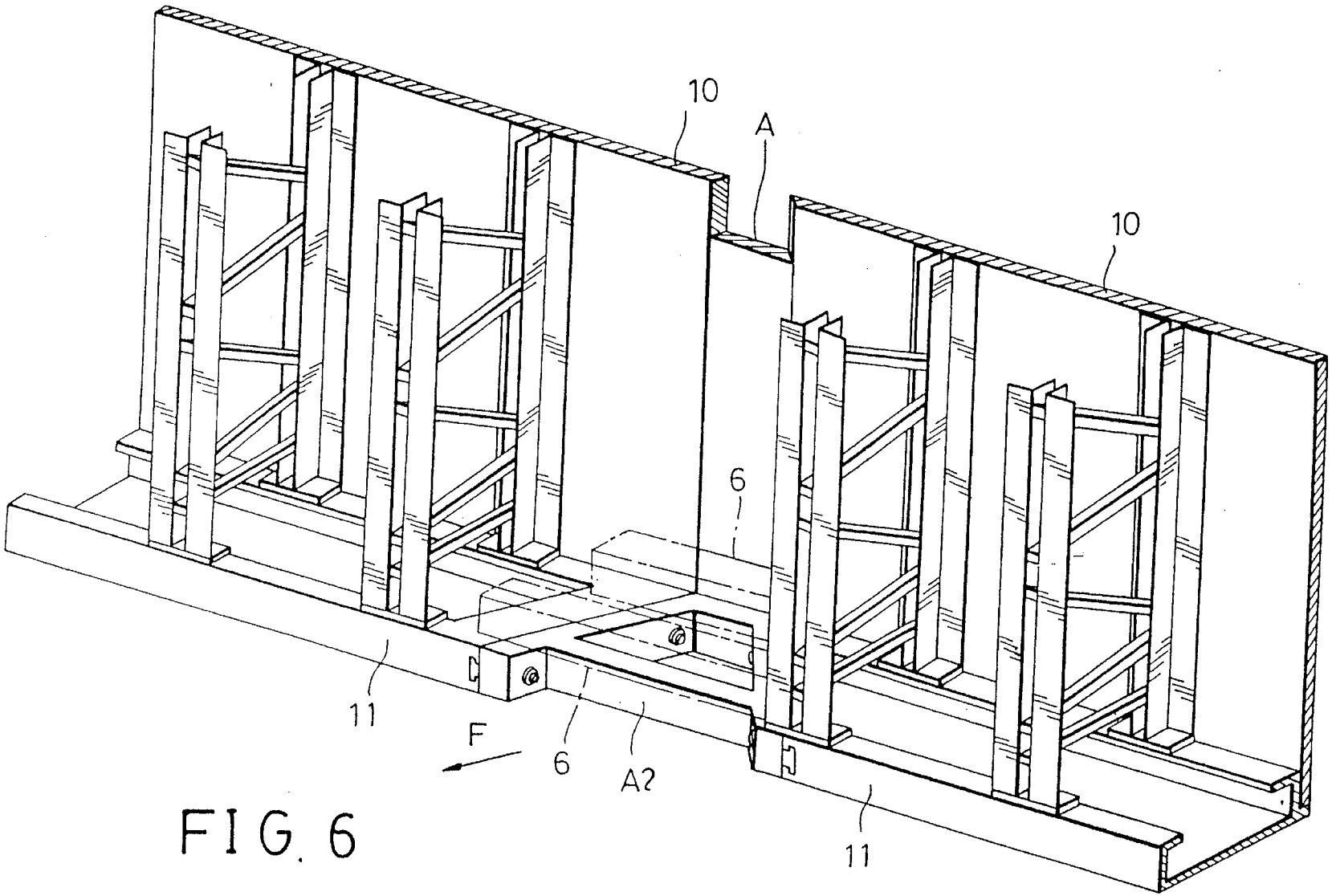
FIG. 6 is a schematic perspective view illustrating the driving assembly in FIG. 5 when the driving assembly is used with a conventional form set-up.

Referring now to FIG. 6, the driving assembly 6 can be incorporated in a conventional form set-up shown in FIG. 1 so as to facilitate stripping of the form panels 10 of the conventional form set-up from the concrete unit (C) (see FIG. 1). The interconnecting member (A) is wedged between two form panels 10 and has an A-shaped base member (A2) which is interposed between the reinforcing beam members 11 of the form panels 10. Operation of the driving assembly 6 will result in movement of the form panels 10 toward each other so as to force the interconnecting member (A) and the base member (A2) to move in the direction indicated by the arrow (F), thereby stripping the from panels 10 from the concrete unit (C).

Figure 7:
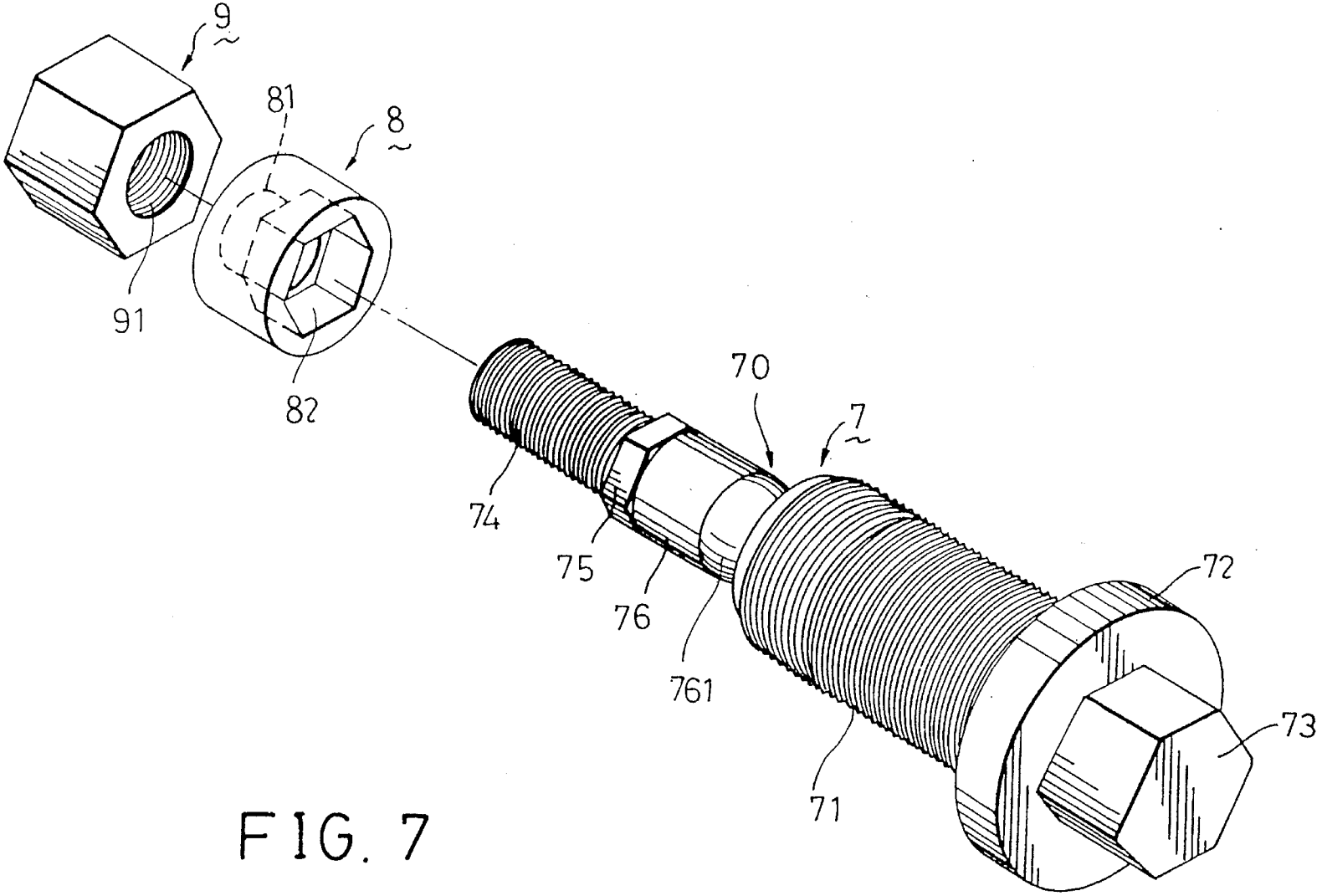
FIG. 7 is an exploded view showing a driving assembly of a form set-up according to a second embodiment of the present invention.
Figure 8:
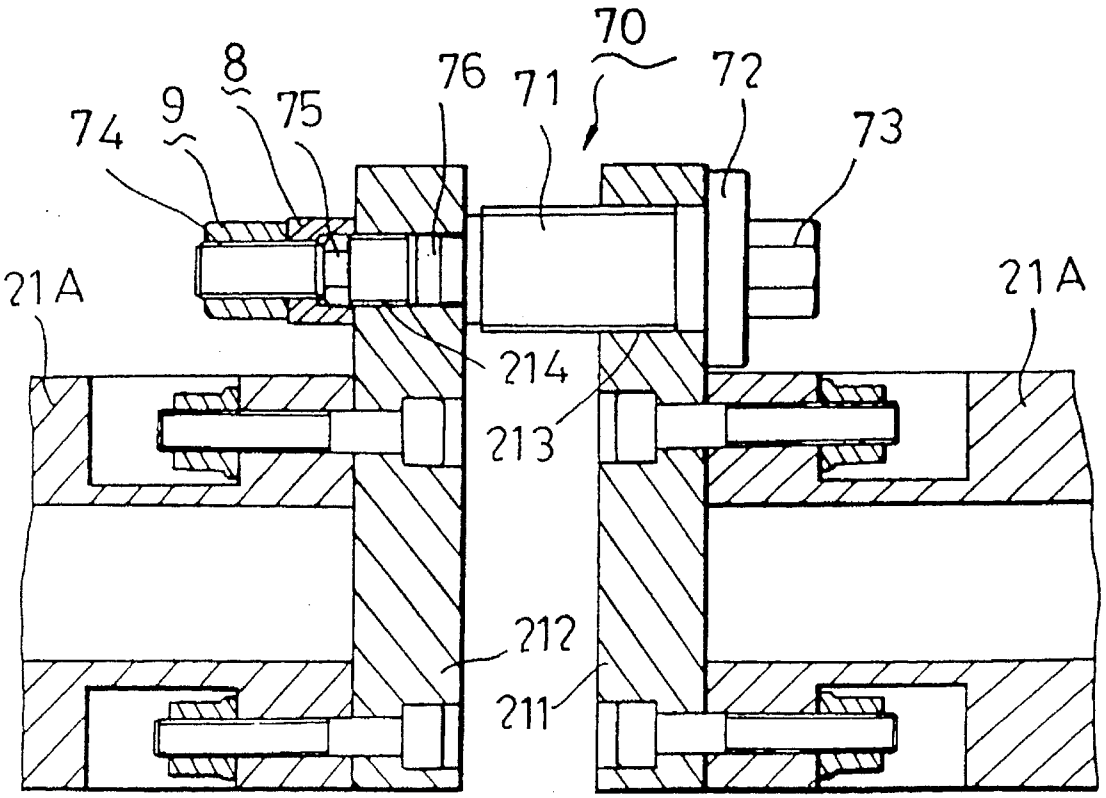
FIG. 8 is a fragmentary partial sectional view showing a portion of the form set-up according to the second embodiment of the present invention.

Referring to FIGS. 7 and 8, a second embodiment of the present invention is shown. Unlike the first embodiment, the driving assembly 7 includes a first mounting seat 211 which is connected to the reinforcing beam member (21A) of one of the two selected form panels (not shown) adjacent to the interconnecting member (not shown) and which is formed with a screw hole 213 therethrough. The screw hole 213 extends in a direction parallel to the reinforcing beam members (21A). A second mounting seat 212 is connected to the reinforcing beam member (21A) of the other one of the two selected form panels (not shown) adjacent to the interconnecting member and is formed with a through-hole 214 therethrough. The through-hole 214 of the second mounting seat 212 is axially aligned with the screw hole 213 of the first mounting seat 211.

An elongated rod 70 has an enlarged threaded first portion 71 which extends threadably through the screw hole 213 of the first mounting seat 211 and which is sized to prevent extension of the first portion 71 through the through-hole 214 of the second mounting seat 212. The first portion 71 is formed with an actuating head 73 which is located away from the second mounting seat 212. The first portion 71 is further formed with a radially and outwardly extending flange 72 which is adjacent to the actuating head 73 and which is sized to prevent the extension thereof through the screw hole 213 of the first mounting seat 211. The elongated rod 70 further has a second portion 74 which extends through the through-hole 214 of the second mounting seat 212 and which is externally threaded. The first and second portions, 71 and 74 of the elongated rod 70 extends on two sides of the second mounting seat 211. The elongated rod 70 further has a third portion 76 which interconnects the first and second portions, 71 and 74, and which extends through the through-hole 214 of the second mounting seat 212. The third portion 76 is formed with an annular projection 761 which is arcuate in cross-section and which is located adjacent to the first portion 71. The third portion 76 has a polygonal member 75 which is mounted securely thereon and which is located adjacent to the second portion 74. The polygonal member 75 is exposed from the through-hole 214 of the second mounting member 212.

A stop unit includes a sleeve member 8 and a locking nut 9. The sleeve member 8 is formed with a receiving hole 82 which complements the polygonal member 75 so as to receive the polygonal member 75 therein, and a rod-extending hole 81 which is in communication with the receiving hole 82 and which is sized to permit the extension of the second portion 74 of the elongated rod 70 therethrough while preventing the extension of the polygonal member 75 therethrough. The sleeve member 8 is sized to prevent the extension thereof through the through-hole 214 of the second mounting member 212. The locking nut 9 is connected threadably 91 to the second portion 74 of the elongated rod 7 so as to bias the sleeve member 8 to abut against the second mounting seat 212.

To strip the form panels from the concrete unit, the actuating head 73 of the elongated rod 70 is rotated in a first direction so as to rotate the elongated rod 70. It should be noted that since the sleeve member 8 is sleeved on the polygonal member 75, and since the locking nut 9 biases the sleeve member 8, rotation of the elongated rod 70 will cause synchronous rotation of the sleeve member 8 and the locking nut so that no angular rotation of the locking nut 9 relative to the elongated rod 70 will occur, thereby preventing axial movement of the elongated rod 70 relative to the second mounting seat 212. Thus, rotation of the elongated rod 70 will cause the first mounting seat 211 to move toward the second mounting seat 212, thereby resulting in a relative movement between the form panels of the first and second wall parts so as to separate the form panels from the concrete unit. On the other hand, rotation of the elongated rod 70 in a second direction opposite to the first direction will cause the first mounting seat 211 to move away from the second mounting seat 212 until the first mounting seat 211 abuts against the flange 72 of the elongated rod 70.

It should be appreciated that the first mounting seat 211 is ideally parallel to the second mounting seat 212 during the movement of the first mounting seat 211 toward the second mounting seat 212. The provision of the projection 761 permits smooth operation of the elongated rod 70 when the first mounting seat 211 slightly deviates from being parallel to the second mounting seat 212 during the movement of the first mounting seat 211 toward the second mounting seat 212.

Figure 9:
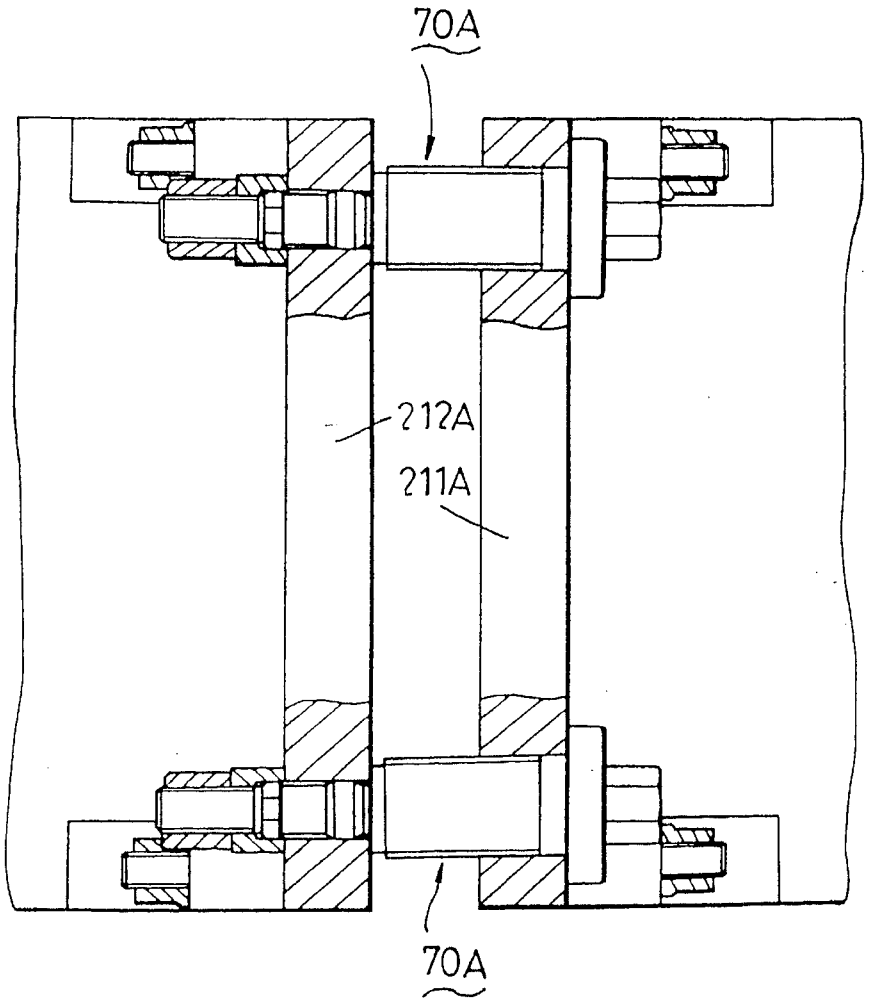
FIG. 9 is another fragmentary partial sectional view showing the form set-up in FIG. 8.

Referring now to FIG. 9, a third embodiment is shown. In the present embodiment, two elongated rods (70A) are provided between the first and second mounting seats (211A and 212A). In operation, the two elongated rods (70A) are operated simultaneously.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A method for stripping upright form panels from a concrete unit having at least one vertical surface, said upright form panels constituting a form set-up defining a pouring space into which concrete is poured and cast so as to form said concrete unit, said form set-up including at least two of said upright form panels and an interconnecting member interposed removably between said two upright form panels, each of said two upright form panels having a contact surface in contact with said vertical surface of said concrete unit, a mounting surface opposed to said contact surface, and a substantially horizontally positioned reinforcing beam member secured to said mounting surface, said reinforcing beam members of said upright form panels being aligned with each other, said interconnecting member having a contact surface which is flush with said contact surfaces of said two upright form panels and which is in contact with said vertical surface of said concrete unit, said method comprising the steps of:

(a) interposing a driving assembly between said reinforcing beam members;

(b) removing said interconnecting member from said two upright form panels so as to leave a space between said two upright form panels; and (c) activating said driving assembly to move said reinforcing beam members toward each other so as to move said two upright form panels toward each other in order to separate said two upright form panels from said concrete unit.

2. A method for stripping form panels as claimed in claim 1, further comprising, prior to step (b), a step of providing a handle member on said interconnecting member, in such a manner that said handle member is gripped by a hand of an operator to assist in said removal of said interconnecting member from said two upright form panels in step (b).

3. A form set-up defining a pouring space into which concrete is poured and cast so as to form a concrete unit, said concrete unit having at least one vertical surface, said form set-up comprising:

at least two upright form panels, each of said upright form panels having a contact surface in contact with said vertical surface of said concrete unit, a mounting surface opposed to said contact surface, and a substantially horizontally positioned reinforcing beam member secured to said mounting surface, said reinforcing beam members of said two upright form panels being aligned with each other;

an interconnecting member interposed removably between said two upright form panels, said interconnecting member having a contact surface which is flush with said contact surfaces of said two upright form panels and which is in contact with said vertical surface of said concrete unit; and a driving assembly interposed between said reinforcing beam members and activable to move said reinforcing beam members toward each other so as to move said two upright form panels toward each other in order to separate said two upright form panels from said concrete unit after said interconnecting member is removed from said upright form panels.

4. A form set-up as claimed in claim 3, wherein said driving assembly includes:

a first mounting seat secured to said reinforcing beam member of a first one of said two upright form panels adjacent to said interconnecting member;

a second mounting seat secured to said reinforcing beam member of a second the other one of said two upright form panels adjacent to said interconnecting member; and a hydraulic cylinder having a stationary body which is mounted on one of said mounting seats, and a piston rod which has a distal end extending outwardly from said stationary body and which is connected securely to the other one of said mounting seats, said hydraulic cylinder being activable to move said distal end of said piston rod toward said stationary body.

5. A form set-up as claimed in claim 4, wherein said driving assembly further includes a stop member which is interposed removably between said mounting seats so as to prevent untimely movement of said distal end of said piston rod toward said stationary body, wherein removal of said stop member from said mounting seats permits movement of said distal end of said piston rod toward said stationary body.

6. A form set-up as claimed in claim 3, wherein said driving assembly includes:

a first mounting seat secured to said reinforcing beam member of a first one of said two upright form panels adjacent to said interconnecting member and formed with a screw hole therethrough, said screw hole extending in a direction parallel to said reinforcing beam members;

a second mounting seat secured to said reinforcing beam member of a second one of said two upright form panels adjacent to said interconnecting member and formed with a through-hole therethrough, said through-hole of said second mounting seat being axially aligned with said screw hole of said first mounting seat;

an elongated rod extending through said through-hole of said second mounting seat, said elongated rod having an enlarged threaded first portion which extends threadably through said screw hole of said first mounting seat and which is sized to prevent extension of said first portion through said through-hole of said second mounting seat, and a second portion extending out of said through-hole of said second mounting seat in such a manner that said first and second portions of said elongated rod extend on two sides of said second mounting seat; and a stop unit connected to said second portion of said elongated rod so as to prevent axial movement of said elongated rod toward said first mounting seat;

whereby, rotation of said elongated rod is translated into movement of said first mounting seat toward said second mounting seat, thereby resulting in movement of said two upright form panels toward each other.

7. A form set-up as claimed in claim 6, wherein said elongated rod further has a third portion which interconnects said first and second portions thereof and which extends through said through-hole of said second mounting seat, said third portion being formed with an annular projection which is arcuate in cross-section.

* * * * *